US006666330B2

(12) United States Patent
Sedon et al.

(10) Patent No.: US 6,666,330 B2
(45) **Date of Patent: *Dec. 23, 2003**

(54) SECURITY CONTAINER HAVING COMBINATION MECHANICAL AND MAGNETIC LOCKING MECHANISM

(75) Inventors: Nicholas M. Sedon, Massillon, OH (US); James A. McGill, Canton, OH (US)

(73) Assignee: Alpha Security Products, Inc., North Canton, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/201,348

(22) Filed: Jul. 22, 2002

(65) Prior Publication Data

US 2002/0185397 A1 Dec. 12, 2002

Related U.S. Application Data

(63) Continuation of application No. 09/648,579, filed on Aug. 25, 2000, now Pat. No. 6,422,387.

(60) Provisional application No. 60/151,163, filed on Aug. 27, 1999.

(51) Int. Cl.[7] ..... B65D 85/575

(52) U.S. Cl. ..... 206/387.11; 206/1.5; 70/57.1

(58) Field of Search ..... 206/1.5, 308.2, 206/387.11, 807; 220/324, 326; 70/57.1, 63

(56) References Cited

U.S. PATENT DOCUMENTS 4,966,020 A * 10/1990 Fotheringham et al. ..... 70/276
5,149,153 A * 9/1992 Drewry et al. ..... 292/104
5,524,752 A * 6/1996 Mazzucchelli ..... 206/308.2
5,588,315 A * 12/1996 Holmgren ..... 70/57.1
5,762,187 A * 6/1998 Belden et al. ..... 206/308.2
5,768,922 A * 6/1998 Lax ..... 70/276
5,904,246 A * 5/1999 Weisburn et al. ..... 206/308.2
5,944,185 A * 8/1999 Burdett et al. ..... 206/387.11
5,944,396 A * 8/1999 Stephan ..... 312/204
5,988,376 A * 11/1999 Lax ..... 206/308.2
6,125,668 A * 10/2000 Belden, Jr. ..... 70/57.1
6,135,280 A * 10/2000 Burdett et al. ..... 206/387.11

* cited by examiner

*Primary Examiner*—Shian Luong
(74) *Attorney, Agent, or Firm*—Sand & Sebolt

(57) ABSTRACT

A security container for holding an object includes a frame forming a storage chamber. The frame has an access opening for inserting and removing the object into and from the storage chamber. A lock mechanism is mounted on the frame and movable between locked and unlocked positions. The lock mechanism selectively blocks and unblocks the access opening. The locked mechanism includes at least one mechanically activated locking element and at least one magnetically activated locking element. Each of the locking elements includes a cantilevered locking finger that is movable between locked and unlocked positions. The magnetically activated locking finger is movable to the unlocked position through use of a magnet while the mechanically activated locking element is moved to the unlocked position through use of a pin. Each locking finger engages a blocking plate that is disposed on the sliding member of the locked mechanism. The locked mechanism may only be opened when the lock pin and magnet are used simultaneously.

13 Claims, 5 Drawing Sheets

SECURITY CONTAINER HAVING COMBINATION MECHANICAL AND MAGNETIC LOCKING MECHANISM

CROSS-REFERENCE TO RELATED APPLICATIONS

This application is a continuation of Ser. No. 09/648,579 filed on Aug. 25, 2000 U.S. Pat. No. 6,422,387 issued Jul. 23, 2002, which claims priority from U.S. Provisional Application Serial No. 60/151,163 filed Aug. 27, 1999, the disclosures of which are incorporated herein by reference.

BACKGROUND OF THE INVENTION

1. Technical Field

The present invention relates to containers and, more particularly, to a container for storing various articles such as video and audio cassettes, compact discs, video games, software, and other types of recorded media. Specifically, the invention relates to a storage container for recorded media that can be securely locked in a closed position preventing the unauthorized removal of the contents of the container until a store clerk or owner of the container unlocks the container with a specialized key.

2. Background Information

Containers, and in particular, light weight inexpensively molded plastic containers, are used for a variety of purposes including the storage of various articles. One use of such plastic containers is for the storage of video and audio cassettes, and other recorded media, for both display and sale, as well as for home storage. One particular use of such plastic containers, which preferably are formed of a transparent material, is the display of an item of recorded media at a retail store. It is desired that the item of recorded media be locked within the container to prevent the unauthorized removal of the article from the container, thereby preventing the unauthorized removal of the recorded media from the store. The container may contain an E.A.S. tag (Electronic Article Surveillance) located inside the container that will sound an alarm if a thief attempts to remove the container having the E.A.S. tag from the store passed a security check point.

The present invention provides an inexpensive plastic case for storing various articles, such as video and audio cassettes, various software, etc., that will be contained in a secured locked position preventing the unauthorized removal of the article, E.A.S. tag, or other object from within the security container, until the container has been unlocked and opened by authorized personnel.

One problem common to most inexpensive security containers that can be handled by the consumer is the risk that the lock of the security container can be "picked" by a thief. There is a requirement that the locks of these security containers be able to be molded in one step molding processes. Thus, the locks of the security containers cannot include a large number of intricate interacting members because the locks could not be affordable manufactured. The somewhat limited nature of the manufacturing process has forced the lock design in the past to rely on a plurality of uniquely spaced or uniquely shaped keyholes to provide one feature of security. For instance, the security device disclosed in U.S. Pat. No. 5,762,187 utilizes six spaced apart keyholes that are disposed in relation to 6 locking fingers. The device may only be opened from the locked position when six key prongs are inserted through the six keyholes to move all six locking fingers simultaneously. Although this task is difficult for a thief, a thief can fabricate a key for the device after studying the device or studying the key at the checkout counter.

In order to make the locks of these security containers harder to pick, the industry has started using magnetically-attractable lock materials that are moved from the locked position to the unlocked position by utilizing magnetic force. These components are generally sized to require a relatively strong magnet to move the locked components. Magnets of this strength are generally expensive and not commonly available thus frustrating a thief's attempts to unlock the devices. Furthermore, the keys utilizing the magnets do not readily disclose the position of the magnet because the magnets are typically hidden behind an opaque wall. Thus, a thief cannot readily study the key or the device to determine where the magnetic force must be applied to unlock the device.

Although such devices exist and are suitable for their intended purposes, room for improvement remains. It is desired in the art to provide a locking mechanism for a security container that utilizes both mechanical and magnetic force to unlock the device. Such a device would require a thief to possess a strong magnet, position the strong magnet in the proper location, and apply a mechanical key prong to the device to unlock the device. Although such a complex unlocking requirement is relatively easily achieved with a pre-designed key, a thief attempting to pick the lock will undoubtedly draw attention to himself as he attempts to position all of the elements in a retail environment.

SUMMARY OF THE INVENTION

In view of the foregoing, it is an objective of the present invention to provide a lock for a security container having a magnetic element and a mechanical element that must both be unlocked for the security device to be opened.

Another objective of the present invention is to provide such a lock for a security container that can be utilized with a wide variety of security containers.

Another objective of the present invention is to provide a lock for a security container that provides for a receiving space for an E.A.S. tag that can be attached inside the security device.

Another objective of the present invention is to provide a lock for a security device that is formed of light weight molded plastic in combination with a magnetically-attractable material, such as metal, that can be mass produced relatively inexpensively.

Another objective of the present invention is to provide a lock for a security device wherein the lock elements are hidden from public view so that a thief cannot readily discern how to pick the lock.

Another objective of the present invention is to provide a lock for a security device having two locking fingers that move from the locked position to the unlocked position in opposite directions on either side of a blocking wall to prevent the lock from being easily picked.

A further objective of the present invention is to provide a lock for a security container that is of simple construction, that achieves the stated objectives in a simple, effective, and inexpensive manner, that solves the problems and that satisfies the needs existing in the art.

These and other objective's and advantages are obtained by the improved security container of the present invention, the general nature of which may be stated as including a security container for holding an object, the container including a frame forming a storage chamber; the frame having an access opening for inserting and removing the object into and from the storage chamber; a lock mechanism mounted on the frame movable between locked and unlocked positions; the lock mechanism selectively blocking and unblocking the access opening; and the lock mechanism including at least one mechanically activated locking element and at least one magnetically activated locking element.

BRIEF DESCRIPTION OF THE DRAWINGS

A preferred embodiment of the invention illustrative of the best mode in which Applicant has contemplated applying the principles of the invention, is set forth in the following description and is shown in the drawings and is particularly and distinctly pointed out and set forth in the appended claims.

Similar numbers refer to similar parts throughout the drawings.

DESCRIPTION OF THE PREFERRED EMBODIMENT

Figure 1:
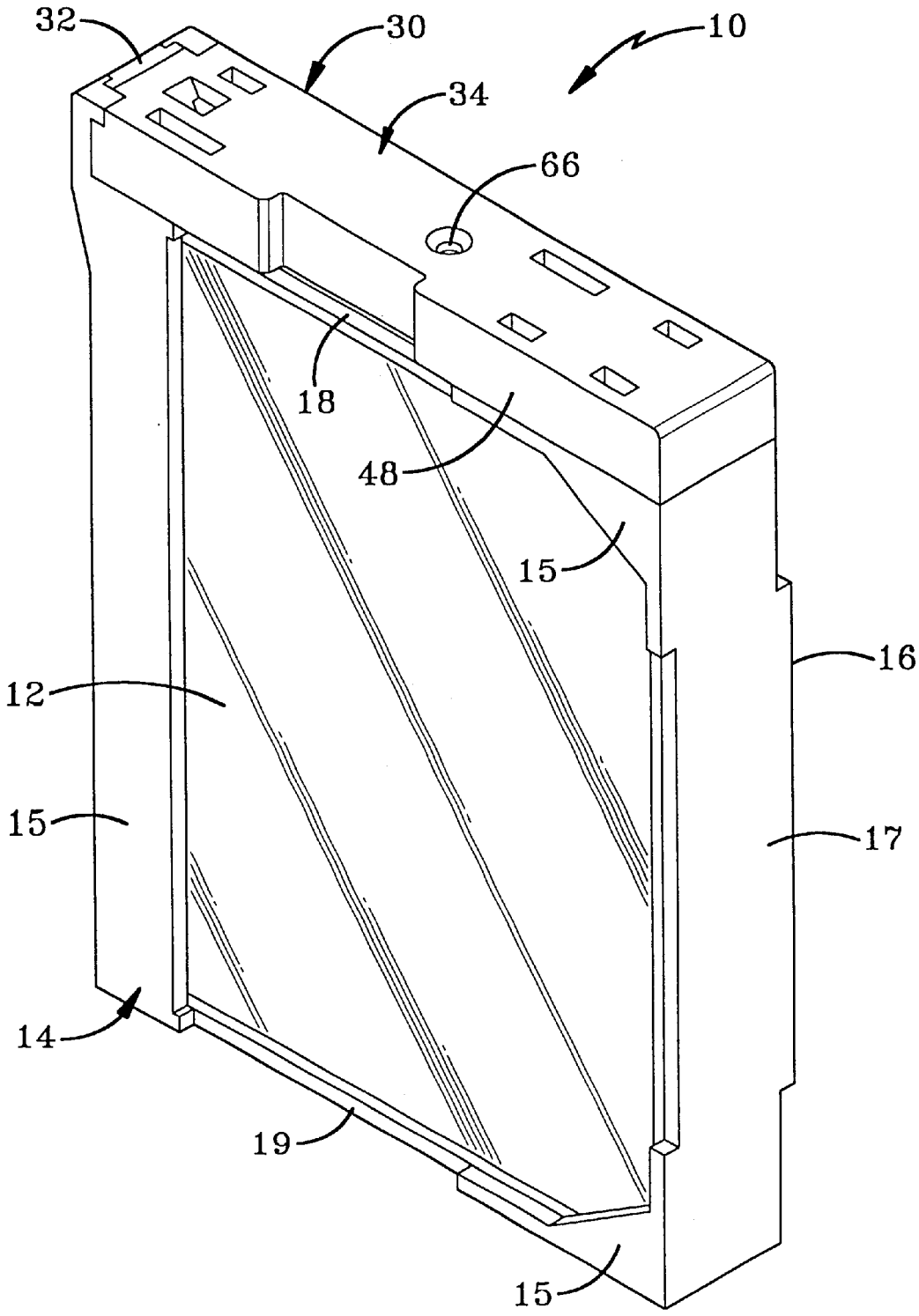
FIG. 1 is a perspective view of the security container of the present invention shown holding a typical cassette tape case.
Figure 2:
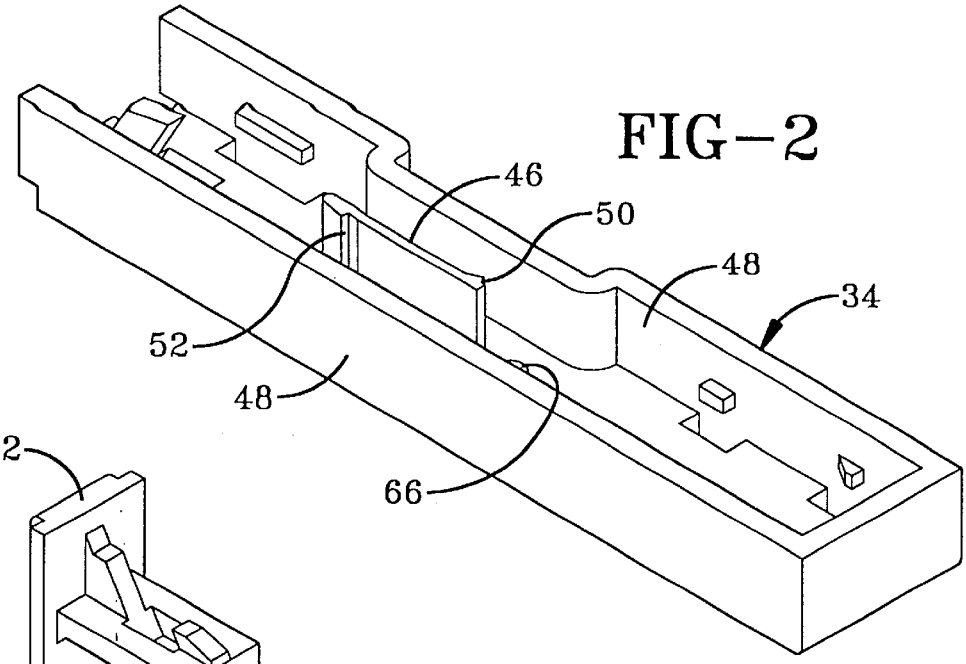
FIG. 2 is a perspective view of the slide plate showing the blocking wall of the lock of the present invention.
Figure 3:
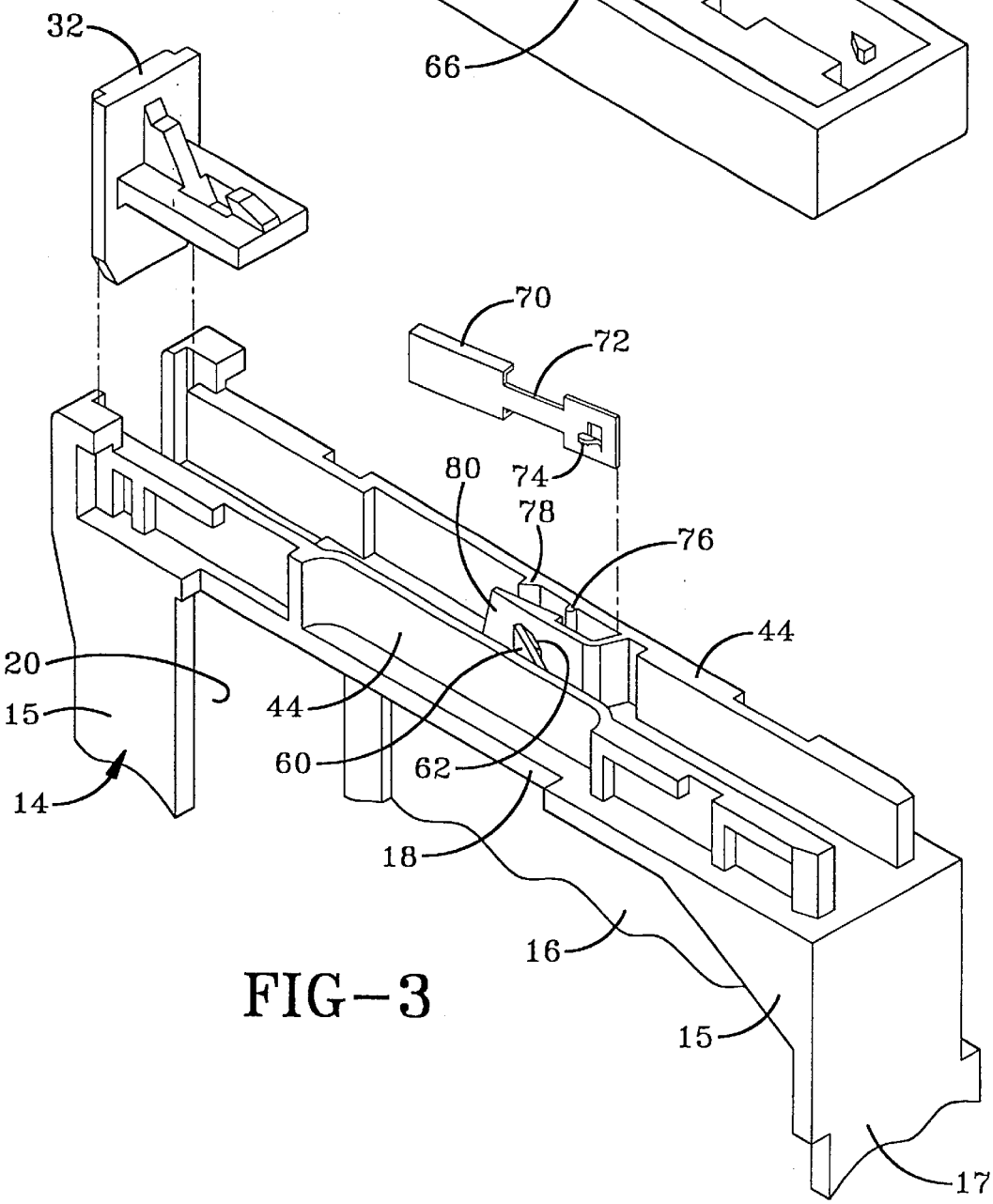
FIG. 3 is a perspective view of one end of the security container of the present invention showing the mechanical and magnetic lock elements.

The security container of the present invention is indicated generally by the numeral 10 in the accompanying drawings. For purposes of example, security container 10 is depicted in the closed position securely retaining a cassette tape 12 in FIG. 1. Although a cassette tape package 12 is shown the drawings and discussed below, security container 10 may be used and configured to store a variety of objects and is intended primarily for recorded media such as VHS cassettes, audio cassettes, electronic games, compact discs, DVD's, and other types of recorded music, software packages, or video packages which are usually contained within a separate storage case, such as jewel boxes, or other types of boxes. Container 10 includes a frame indicated generally by the numeral 14 that is molded of a preferably relatively rigid plastic material such as polycarbonate, and has a parallelepepedic configuration with a pair of spaced parallel side walls 15 and 16, a rear wall 17, and spaced parallel end walls 18 and 19. Walls 15–19 form an interior storage chamber or compartment 20 for receiving and storing an article which is inserted into and removed from the compartment or chamber through an elongated end access opening 22. Opening 22 extends generally throughout the longitudinal length defined by walls 15 and 16, as well as the transverse length defined by end walls 18 and 19.

Figure 4:
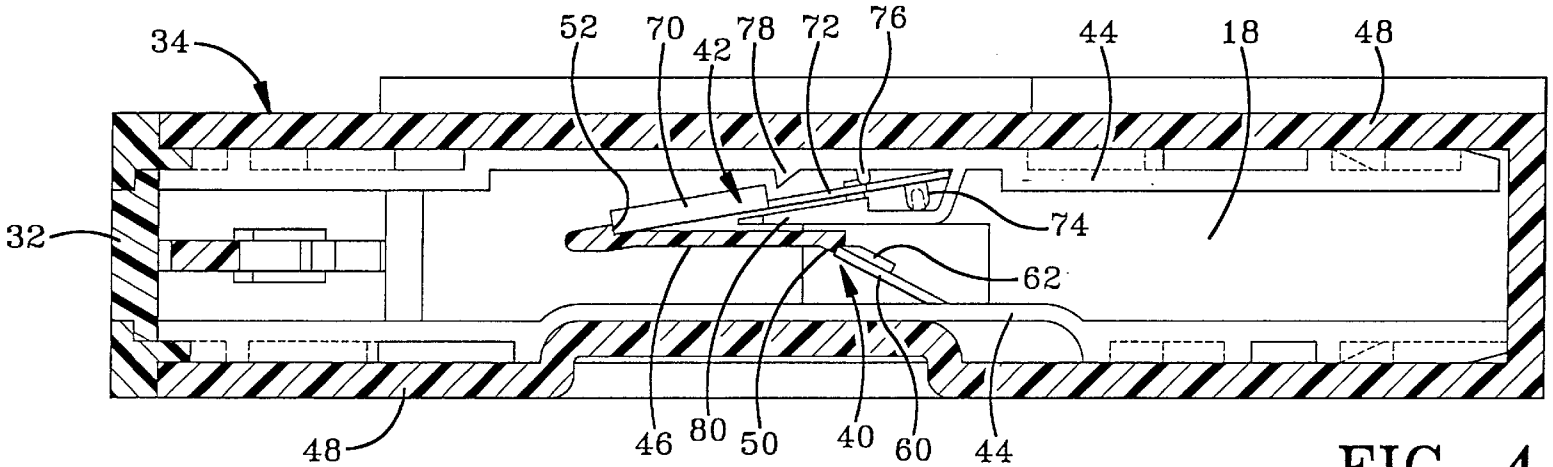
FIG. 4 is a top plan view of the lock device with the top wall of the slide plate removed showing the lock in a locked position.
Figure 5:
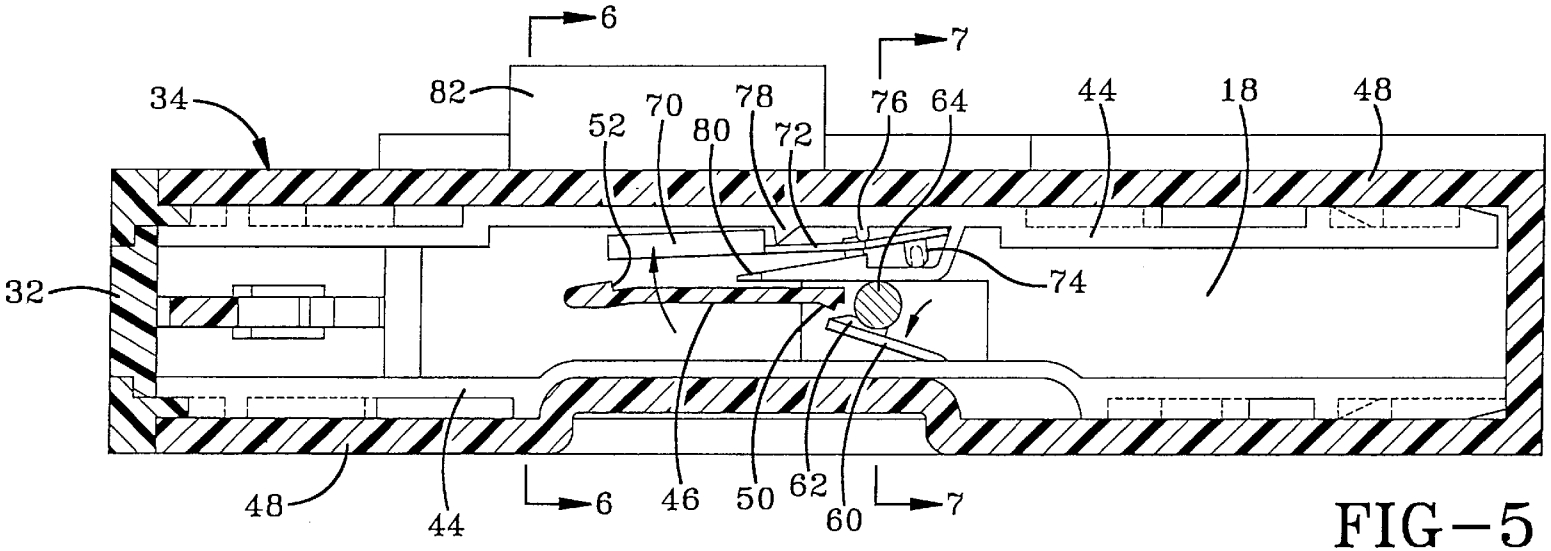
FIG. 5 is a view similar to FIG. 4 showing the lock in an unlocked position.
Figure 7:
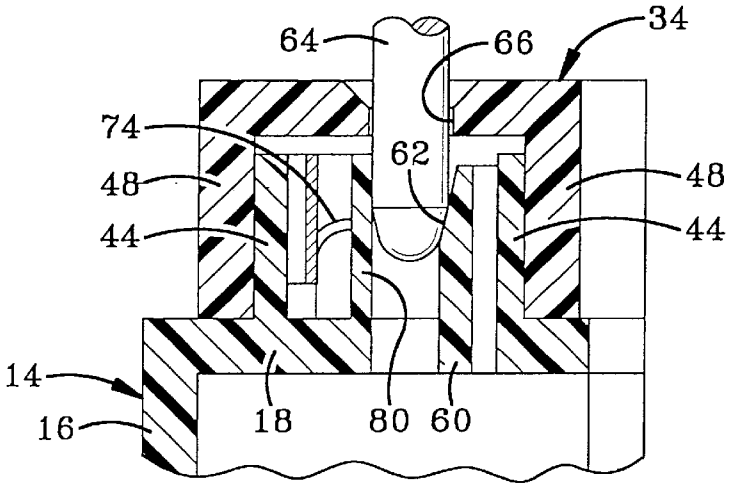
FIG. 7 is a sectional view taken along line 7—7 of FIG. 5.
Figure 6:
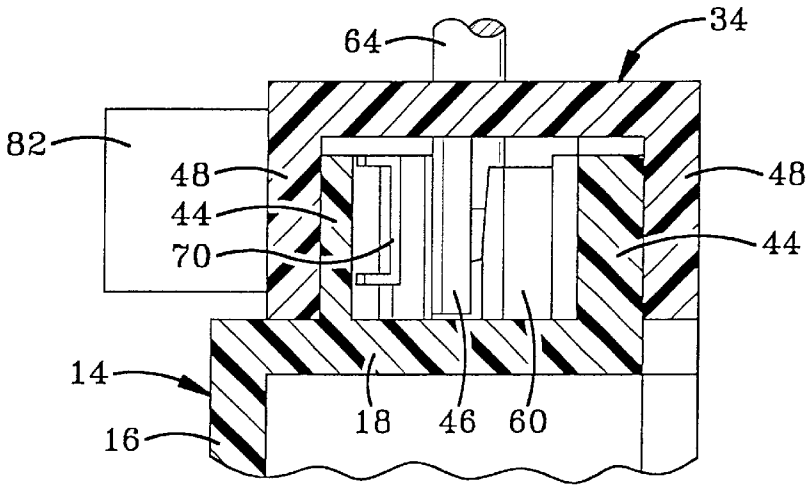
FIG. 6 is a sectional view taken along line 6—6 of FIG. 5.
Figure 8:
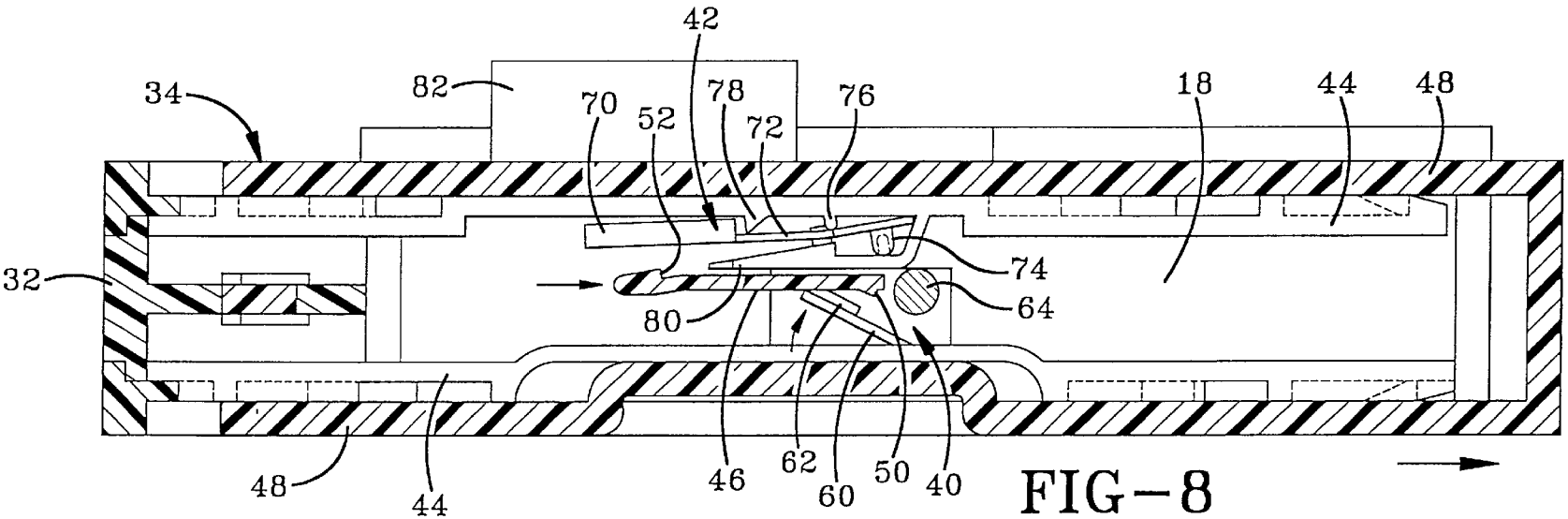
FIG. 8 is a view similar to FIG. 4 showing the slide plate being moved to the unlocked position.
Figure 9:
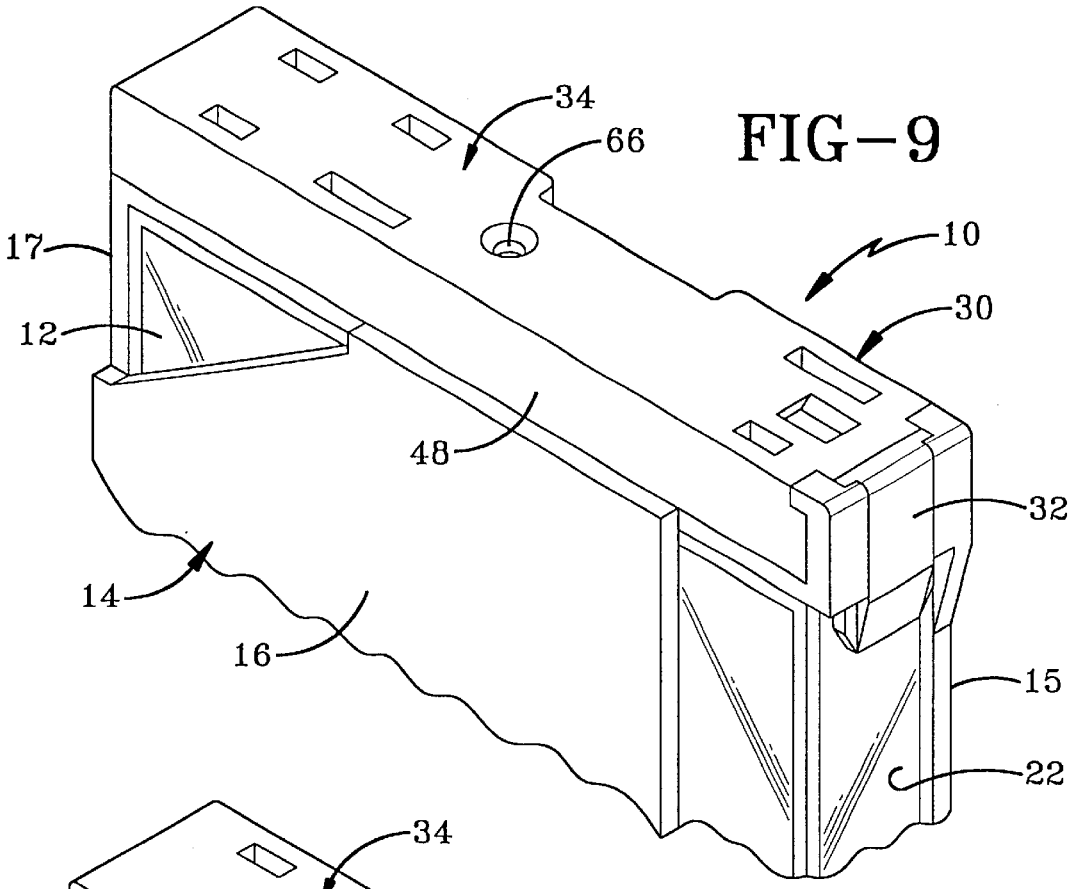
FIG. 9 is a perspective view of the security device in a locked position.
Figure 10:
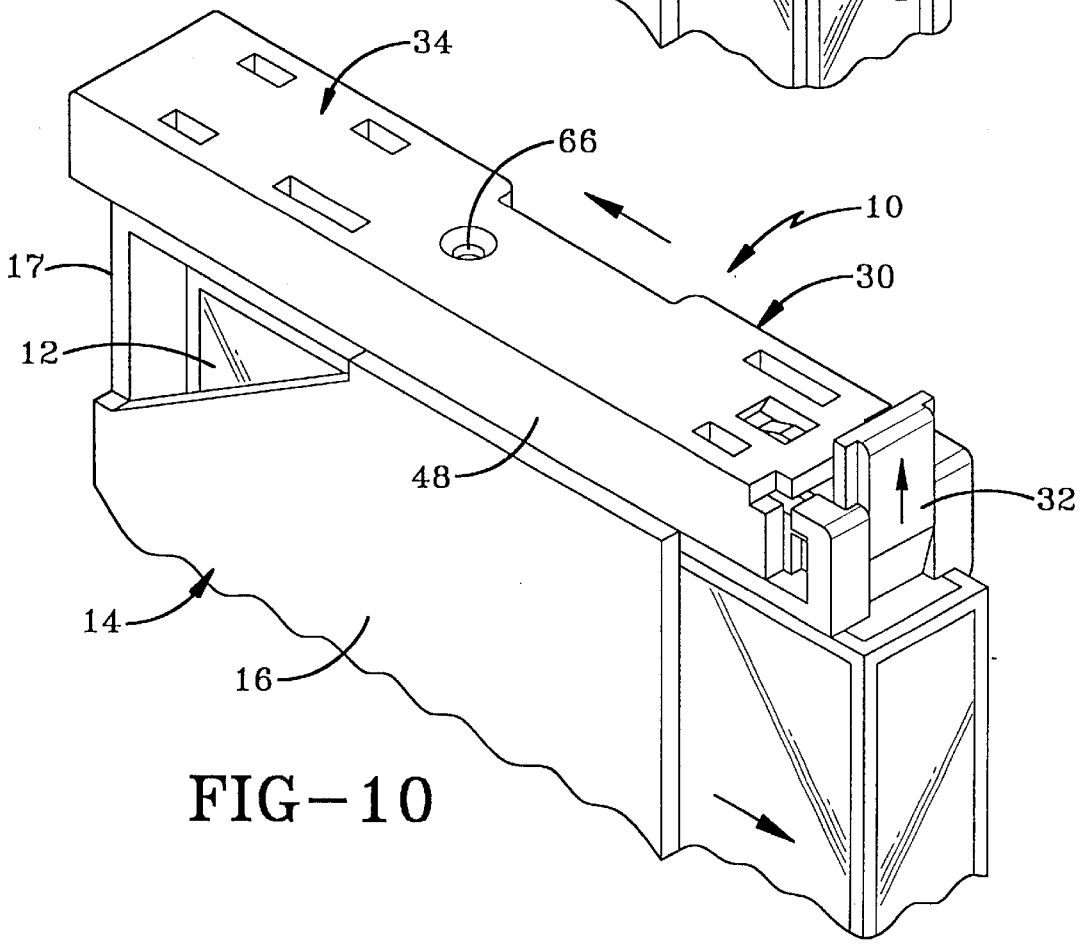
FIG. 10 is a perspective view of the security device in the unlocked position.

Security container 10 includes a lock mechanism 30 that is movable on frame 14 between locked and unlocked positions. The locked position of lock mechanism 30 is depicted in FIGS. 1, 4, and 9 with the unlocked position being depicted in FIG. 10. Lock mechanism 30 selectively blocks access opening 22 when in the locked position by blocking a portion of access opening with a lock tab 32. Lock tab 32 is driven between its locked and unlocked position by a slide plate 34. The structure and operation of lock tab 32 and slide plate 34 is described fully in U.S. Pat. No. 5,762,187 that issued on Jun. 9, 1998 to the Assignee of the present application. The disclosures of U.S. Pat. No. 5,762,187 are incorporated herein by reference to form a part of this specification for the purposes of describing the operation of lock tab 32 and slide plate 34. In general, it is understood that longitudinal movement of slide plate 34 with respect to frame 14 creates corresponding longitudinal movement of lock tab 32 in a direction substantially perpendicular to a movement of slide plate 34. The locking elements disclosed in U.S. Pat. No. 5,762,187 include six locking fingers that engage six corresponding locking projections. The locking fingers are purely mechanically activated and deactivated.

Lock mechanism 30 of the present invention includes both a mechanically activated locking element 40 in combination with at least one magnetically activated locking element 42. In the preferred embodiment of the present invention, each element 40 and 42 selectively engages slide plate 34 and locks the position of slide plate 34 with respect to frame 14. When the position of slide plate 34 is locked with respect to frame, security container 10 and elements 40 and 42 are said to be in the locked position. When elements 40 and 42 allow slide plate 34 to move with respect to frame 14, security container 10 and elements 40 and 42 are said to be in the unlocked position. Mechanically activated lock element 40 is selectively moved between its locked and unlocked position by a mechanical key while magnetically activated lock element 42 is moved between its locked and unlocked positions with a key using magnetic force.

In the preferred embodiment of the present invention, security container 10 includes a pair of slide rails 44 projecting up from wall 18. Slide plate 34 rides on slide rails 44 between the locked and unlocked positions. Slide rails 44 include a plurality of ledges, overhangs, and notches as described in U.S. Pat. No. 5,762,187 that cooperate with slide plate 34 to allow slide plate 34 to be mounted on rails 44 and move between the locked and unlocked positions. In the preferred embodiment of the present invention, lock elements 40 and 42 are disposed between slide rails 44 where they cannot be readily accessed by a potential shoplifter. In another embodiment of the present invention, elements 40 and 42 may both be moved outside slide rails 44 or one of elements 40 and 42 may be moved outside of slide rails 44 as desired by the particular configuration of security container 10 and lock mechanism 30.

Each lock element 40 and 42 selectively engages slide plate 34 as described above. In the preferred embodiment of the present invention, slide plate 34 includes a blocking wall 46 which is engaged in by each lock element 40 and 42. In other embodiments of the present invention, slide plate 34 may include a pair of blocking walls 46 or may simply include surfaces on its side walls 48 on which lock elements 40 and 42 engage. In the configuration of the invention depicted in the drawings, blocking wall 46 separates lock element 40 from lock element 42. This configuration also makes it more difficult to pick security device 10.

Blocking wall 46 includes a ledge 50 which is engaged by mechanically activated lock element 40 when lock element 40 is in the locked position. Blocking wall 46 also includes a shoulder 52 that is engaged by magnetically activated lock element 42 when lock element 42 is in the locked position. Ledge 50 and shoulder 52 are separated by a substantial distance along blocking wall 46 so that the critical engagement between elements 40 and 46 and 42 and 46 are not so close together to allow a shoplifter to easily pick lock mechanism 30.

Mechanically activated lock element 40 includes a cantilevered locking finger 60 having a first end connected to slide rail 44 with its second end projecting out into the space where blocking wall 46 slides back and forth with slide plate 34. The second end of locking finger 60 is positioned to engage ledge 50 when locking finger 60 is the locked position. Locking finger 60 includes an angled cam plate 62 disposed adjacent its second end. Cam plate 62 is used to move locking finger 60 from the locked to the unlocked position when a pin 64 of a key engages cam plate 62 pivoting locking finger 60 about its first end causing the second end of locking finger 60 to move away from ledge 50. It is preferred that locking finger 60 be fabricated from a plastic material that is not magnetically attractive. Pin 64 may be inserted through an opening 66 disposed in slide plate 34 and aligned with ledge 50 and cam plate 62 when slide plate 34 is in the locked position.

Magnetically activated lock element 42 includes a cantilevered locking finger 70 that is primarily fabricated from a magnetically attractive material. At least one portion of locking finger 70 is fabricated from the magnetically attractive material so that locking finger 70 may be moved from its locked position to its unlocked position with a magnet that is selectively positioned outside of lock mechanism 30. Locking finger 70 may be preferably fabricated from a metal. In the preferred embodiment, locking finger 70 has a U-shaped cross section that gives locking finger 70 rigidity. The U-shaped cross section, however, extends only over the outer portion of locking finger 70 adjacent its second end so that locking finger 70 may readily pivot about an area 72 having a reduced cross section. The first end of locking finger 70 is anchored adjacent slide rail 44 and may be secured in place with a locking tab 74. A pivot member 76 is disposed near the first end of locking finger 70 but between the first end of locking finger 70 and the second end of locking finger 70. Locking finger 70 pivots about pivot member 76 when it is moved from its locked position to its unlocked position. A stop 78 also projects from slide rail 44 and is disposed between pivot member 76 and the second end of locking finger 70. The stop 78 contacts locking finger 70 when locking finger 70 is in the unlocked position. Stop 78 prevents locking finger 70 from moving too far away from the locked position. A resting wall 80 is provided on the opposite side of locking finger 70 than pivot member 76 and stop 78 to provide a substantially stable support surface for locking finger 70 to rest against when it is in the locked position. Resting wall 80 provides support to the back side of locking finger 70 to prevent it from being deformed when a thief is attempting to pick lock mechanism 30.

Locking finger 70 is moved to its unlocked position through the use of a magnet 82 that is positioned adjacent side wall 48 and slide rail 44 of security container 10 in the appropriate location. It is desired that there are no locating marks on side wall 48 so that a shoplifter can not readily ascertain where a magnet must be placed to move locking finger 70 to the unlocked position. Another security feature is that locking finger 70 is sized and configured to require a relatively strong magnet 82 to be used to move it to the unlocked position. Such strong magnets 82 are relatively expensive and relatively hard to obtain.

Security container 10 is initially locked by placing item of recorded media 12 through access opening 22 so that it is encased by frame 14. Slide plate 34 is then moved to the locked position driving lock tab 32 over a portion of access opening 22 to prevent item of recorded media 12 from being removed from security container 10. When slide plate 34 is moved to the locked position, blocking wall 46 is moved relative to lock elements 40 and 42 bringing ledge 50 and shoulder 52 into engagement with locking fingers 60 and 70. When blocking wall 46 reaches the locked position, locking fingers 60 and 70 engage blocking wall 46 and prevent it from moving back toward the unlocked position.

Security container 10 may then only be opened by simultaneously inserting pin 64 through opening 66 to move locking finger 60 to the unlocked position while positioning magnet 82 in the proper location to draw or pull locking finger 70 away from blocking wall 46. Lock mechanism 30 may only be unlocked through the simultaneous use of pin 64 and magnet 82. This provides yet another security feature to the device because it requires a shoplifter to simultaneously position two elements to unlock the device.

Accordingly, the improved Security Container Having Combination Mechanical and Magnetic Locking Mechanism apparatus is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness, and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries, and principles of the invention, the manner in which the Security Container Having Combination Mechanical and Magnetic Locking Mechanism is constructed and used, the characteristics of the construction, and the advantageous new and useful results obtained; the new and useful structures, devices, elements, arrangements, parts, and combinations are set forth in the appended claims.

What is claimed is:

1. A security container for holding an item of recorded media, the security container comprising:

a container defining a storage chamber;

the container having an access opening for inserting the item into the storage chamber and for removing the object from the storage chamber;

a lock mechanism movable between locked and unlocked positions;

the lock mechanism locking the access opening when the lock mechanism is in the locked position; and the lock mechanism including and at least one magnetically activated locking element movable between locked and unlocked positions;

the lock mechanism also including a mechanically activated locking element movable between locked and unlocked positions; and the magnetically activated locking element being movable in a direction substantially opposite than the direction of movement for the mechanically activated locking element.

2. The container of claim 1, wherein the magnetically activated locking element includes a cantilevered locking finger.

3. The container of claim 2, wherein the locking finger includes a body having at least one portion fabricated from a magnetically attractive material.

4. The container of claim 1, wherein the mechanically activated locking element is separated from the magnetically activated locking element and is independently operable.

5. The container of claim 1, further comprising a blocking wall disposed between the mechanically activated locking element and the magnetically activated locking element.

6. The container of claim 5, wherein the mechanically activated locking element selectively engages the blocking wall when the lock mechanism is in the locked position.

7. The container of claim 6, further comprising a ledge formed on the blocking wall; the mechanically activated locking element engaging the ledge when the lock mechanism is in the locked position.

8. The container of claim 5, wherein the magnetically activated locking element selectively engages the blocking wall when the lock mechanism is in the locked position.

9. The container of claim 8, further comprising a shoulder formed on the blocking wall; the magnetically activated locking element engaging the shoulder when the lock mechanism is in the locked position.

10. The container of claim 1, wherein the magnetically activated locking element has a first end and a second end; the container comprising a pivot member disposed intermediate the first and second ends of the magnetically activated locking element.

11. The container of claim 10, further comprising a stop disposed between the first and second ends of the magnetically activated locking element; the stop disposed intermediate the pivot member and the second end of the magnetically activated locking element.

12. The container of claim 11, further comprising a resting wall; the magnetically activated locking element selectively movable between locked and unlocked positions; the magnetically activated locking element disposed adjacent the resting wall when the magnetically activated locking element is in the locked position.

13. A security container for holding an item of recorded media, the security container comprising:

a container defining a storage chamber;

the container having an access opening for inserting the item into the storage chamber and for removing the object from the storage chamber;

a lock mechanism movable between locked and unlocked positions;

the lock mechanism locking the access opening when the lock mechanism is in the locked position; and the lock mechanism including and at least one magnetically activated locking element movable between locked and unlocked positions; the magnetically activated locking element being moved to the unlocked position with a first key element;

the lock mechanism also including a mechanically activated locking element movable between locked and unlocked positions; the mechanically activated locking element being moved to the unlocked position with a second key element; and the locking elements being movable to the unlocked positioned independent of one another.

* * * * *